US012618122B2

(12) United States Patent
Honda et al.

(10) Patent No.: US 12,618,122 B2
(45) Date of Patent: May 5, 2026

(54) RECOVERY METHOD OF Ra-226, PRODUCTION METHOD OF Ra-226 SOLUTION, AND Ac-225 SOLUTION PRODUCTION METHOD OF Ac-225 SOLUTION

(71) Applicants: NIHON MEDI-PHYSICS CO., LTD., Tokyo (JP); NATIONAL INSTITUTES FOR QUANTUM SCIENCE AND TECHNOLOGY, Chiba (JP)

(72) Inventors: Yoshio Honda, Tokyo (JP); Taku Ito, Tokyo (JP); Jun Ichinose, Tokyo (JP); Kotaro Nagatsu, Chiba (JP); Hisashi Suzuki, Chiba (JP)

(73) Assignees: NIHON MEDI-PHYSICS CO., LTD., Tokyo (JP); NATIONAL INSTITUTES FOR QUANTUM SCIENCE AND TECHNOLOGY, Chiba (JP)

( * ) Notice: Subject to any disclaimer, the term of this patent is extended or adjusted under 35 U.S.C. 154(b) by 334 days.

(21) Appl. No.: 18/260,515

(22) PCT Filed: Dec. 27, 2021

(86) PCT No.: PCT/JP2021/048690

§ 371 (c)(1),
(2) Date: Jul. 6, 2023

(87) PCT Pub. No.: WO2022/149535

PCT Pub. Date: Jul. 14, 2022

(65) Prior Publication Data

US 2024/0084419 A1 Mar. 14, 2024

(30) Foreign Application Priority Data

Jan. 8, 2021 (JP) ..... 2021-002432

(51) Int. Cl.

| | |
|---|---|
| ***C22B 60/02*** | (2006.01) |
| ***C22B 3/22*** | (2006.01) |
| ***C22B 3/24*** | (2006.01) |
| ***C22B 7/00*** | (2006.01) |
| ***C22B 7/04*** | (2006.01) |

(52) U.S. Cl.

CPC ..... *C22B 60/0295* (2013.01); *C22B 3/22* (2013.01); *C22B 3/24* (2013.01); *C22B 7/005* (2013.01); *C22B 7/04* (2013.01); *C22B 60/026* (2013.01)

(58) Field of Classification Search

CPC ..... C22B 60/0295; C22B 3/22; C22B 3/24; C22B 7/005; C22B 7/04

See application file for complete search history.

(56) References Cited

U.S. PATENT DOCUMENTS

| | | | | |
|---|---|---|---|---|
| 4,654,200 | A | 3/1987 | Nirdosh et al. | |
| 12,046,385 | B2 * | 7/2024 | Kajishiro | C25D 3/54 |

FOREIGN PATENT DOCUMENTS

| | | | | |
|---|---|---|---|---|
| CA | 2593961 | A1 | 1/2008 | |
| CN | 108396146 | A | 8/2018 | |
| EP | 3828899 | A1 * | 6/2021 | G21G 1/12 |
| JP | 2000119765 | A | 4/2000 | |
| WO | 2007096119 | A2 | 8/2007 | |
| WO | 2020256066 | A1 | 12/2020 | |
| WO | 2021002275 | A1 | 1/2021 | |

OTHER PUBLICATIONS

Skinner, Dawn J. 226Ra Contamination of Soil and Foliage as a Function of Distance Downwind from Uranium Mill Tailings. Thesis. 47 pages (Year: 1982).*

Extended European Search Report issued on May 14, 2025, by the European Patent Office in corresponding EP Application No. 21917755.7 (7 pages).

International Search Report (PCT/ISA/210) with English translation mailed on Feb. 8, 2022, by the Japan Patent Office as the International Searching Authority for International Application No. PCT/JP2021/048690. (5 pages).

Written Opinion (PCT/ISA/237) with English translation mailed on Feb. 8, 2022, by the Japan Patent Office as the International Searching Authority for International Application No. PCT/JP2021/048690. (6 pages).

Kozempel et al., "Dissolution of [226Ra]BaSO4 as part of a method for recovery of 226Ra from aged Radium sources," J. Radioanal. Nucl. Chem., 2015, 304, 337-342.

Office Action and Search Report issued on May 30, 2025, by the Russian Patent Office in corresponding RU Application No. 2023120471, with English translation of the Office Action and Search Report (15 pages).

Nuclear Industry Pollution and Its Control, Edited by Nuclear Industry Pollution and Its Control Editorial Team, Beijing: Atomic Energy Press, Jun. 30, 1978, pp. 79-80.

Office Action issued May 30, 2025, by the State Intellectual Property Office of People's Republic of China in corresponding CN Application No. 202180089085.3, and English translation of the Office Action (15 pages).

Office Action issued on Jan. 1, 2026, by the State Intellectual Property Office of People's Republic of China in corresponding CN Application No. 202180089085.3, and English translation of the Office Action (13 pages).

* cited by examiner

*Primary Examiner* — Tima M. McGuthry-Banks
(74) *Attorney, Agent, or Firm* — Panitch Schwarze Belisario & Nadel LLP

(57) ABSTRACT

One aspect of the present invention relates to a recovery method of $^{226}$Ra, and the recovery method of $^{226}$Ra includes a step (A1) of immersing a solid-state $^{226}$Ra containing substance and a carrier having a function of adsorbing $^{226}$Ra ions in a processing solution, and then irradiating the processing solution with ultrasonic waves.

9 Claims, No Drawings

RECOVERY METHOD OF Ra-226, PRODUCTION METHOD OF Ra-226 SOLUTION, AND Ac-225 SOLUTION PRODUCTION METHOD OF Ac-225 SOLUTION

TECHNICAL FIELD

One aspect of the present invention relates to a recovery method of $^{226}$Ra, and a production method of a $^{226}$Ra solution or a production method of a $^{225}$Ac solution.

BACKGROUND ART

In the field of nuclear medicine, radioisotope (RI) internal therapy in which lesions such as tumors are treated by selectively incorporating a drug containing RI has been performed. Among the radiations, alpha rays have a short range, and thus have a characteristic that the effect of unnecessary radiation exposure on surrounding normal cells is small. $^{225}$Ac, which is one of the alpha-emitting nuclides, is a radionuclide with a half-life of 10 days, and has recently been expected as a therapeutic nuclide in cancer treatment.

$^{225}$Ac is produced by, for example, a nuclear reaction of (p, 2n) by irradiating a $^{226}$Ra target with protons using an accelerator. Therefore, in order to produce $^{225}$Ac, $^{226}$Ra is required as a raw material of the $^{226}$Ra target. Until the early 1900s, $^{226}$Ra was produced in a factory from ore and was processed into radium sources for radiation therapy and the like applications, but in recent years, $^{226}$Ra has hardly been produced. Therefore, there is a need for a technique for recovering $^{226}$Ra from a substance containing $^{226}$Ra already produced, such as a radium source, and other naturally collected products containing $^{226}$Ra.

In general, when $^{226}$Ra is recovered from a radium source, a method of collecting a part of a $^{226}$Ra-containing substance from a radium source, determining a chemical form of $^{226}$Ra contained in the radium source, and then extracting and recovering $^{226}$Ra by a treatment method suitable for the chemical form is known.

For example, when the chemical form of $^{226}$Ra is radium sulfate, the radium sulfate is heated in a sodium carbonate aqueous solution to produce radium carbonate, the radium carbonate is filtered through a filter, and then the residue is washed and then dissolved with an acid to recover $^{226}$Ra.

When the chemical form of $^{226}$Ra is radium chloride, the radium chloride is dissolved in water and $^{226}$Ra is recovered.

When the chemical form of $^{226}$Ra is radium carbonate, the radium carbonate is filtered through a filter, and then the residue is washed and then dissolved with an acid to recover $^{226}$Ra.

In addition, in Non Patent Literature 1, an attempt is made to isolate $^{226}$Ra from radium sulfate which is a solid, and the efficiency thereof is evaluated.

CITATION LIST

Non Patent Literature

Non Patent Literature 1: Jan Kozempel et al., Dissolution of [$^{226}$Ra] $BaSO_4$ as part of a method for recovery of $^{226}$Ra from aged Radium sources., J. Radioanal. Nucl. Chem., 2015, 304, 337-342

SUMMARY OF INVENTION

The methods of the related art described above have the following problems.

- The possibility of radiation exposure was high because the operation of collecting $^{226}$Ra samples from radium sources was difficult and complicated.
- It was also difficult to identify the chemical form of $^{226}$Ra, and it was not possible to select an appropriate treatment method in some cases.
- The conversion efficiency from radium sulfate to radium carbonate was not 100%, and the recovery rate of $^{226}$Ra was low because radium sulfate and radium carbonate were slightly dissolved in water.
- When a salt or a reagent used remained in the recovered $^{226}$Ra, there was a concern that the electrodeposition rate would decrease when $^{226}$Ra was electrodeposited for production of a $^{226}$Ra target.

In Non Patent Literature 1, $^{226}$Ra has been successfully quantitatively isolated by several methods, but the reagent for adsorbing $^{226}$Ra used here, particularly EDTA, needs to be dissolved in water, and therefore, a step for separating $^{226}$Ra-EDTA from an aqueous matrix is required in a subsequent operation. In addition, since $^{226}$Ra and EDTA form a strong chelate bond, a step of releasing $^{226}$Ra from EDTA is required. Therefore, there is a problem that the step becomes complicated and the possibility of radiation exposure is high.

One aspect of the present invention provides a recovery method of $^{226}$Ra, and a production method of a $^{226}$Ra solution or a production method of a $^{225}$Ac solution.

One aspect of the present invention is a recovery method of $^{226}$Ra including a step (A1) of immersing a solid-state $^{226}$Ra-containing substance and a carrier having a function of adsorbing $^{226}$Ra ions in a processing solution, and then irradiating the processing solution with ultrasonic waves.

In addition, another aspect of the present invention provides a production method of a $^{226}$Ra solution, the production method including: a step (A1) of immersing a solid-state $^{226}$Ra-containing substance and a carrier having a function of adsorbing $^{226}$Ra ions in a processing solution, and then irradiating the processing solution with ultrasonic waves; a step (A2) of separating the carrier from the processing solution; and a step (A3) of eluting $^{226}$Ra from the carrier separated in the step (A2) using an acid.

Furthermore, still another aspect of the present invention is a production method of a $^{225}$Ac solution, the production method including: a step (B1) of obtaining a $^{226}$Ra solution by the production method of a $^{226}$Ra solution; and a step (B2) of producing a $^{225}$Ac solution from the $^{226}$Ra solution.

According to the recovery method of $^{226}$Ra in one aspect of the present invention, even when a chemical form of $^{226}$Ra is unclear, $^{226}$Ra can be efficiently and simply recovered. In addition, according to the production method of a $^{226}$Ra solution in one aspect of the present invention, even when a chemical form of $^{226}$Ra is unclear, a $^{226}$Ra solution can be efficiently and simply produced. In addition, according to the production method of a $^{225}$Ac solution in one aspect of the present invention, a $^{225}$Ac solution can be efficiently produced using the $^{226}$Ra solution obtained in the production method described above.

DESCRIPTION OF EMBODIMENTS

Next, "to" in the present invention will be specifically described.

The expression "A to B" in the numerical range means A or more and B or less unless otherwise specified. In addition, % means % by mass.

[Recovery Method of $^{226}$Ra]

A recovery method of $^{226}$Ra (hereinafter, also referred to as a "recovery method (X)") in one aspect of the present invention includes a step (A1) of immersing a solid-state $^{226}$Ra-containing substance and a carrier having a function of adsorbing $^{226}$Ra ions (hereinafter, also referred to as a "carrier (i)") in a processing solution, and then irradiating the processing solution with ultrasonic waves.

Step (A1)

In the step (A1), the solid-state $^{226}$Ra-containing substance and the carrier (i) are immersed in the processing solution, and then the processing solution is irradiated with ultrasonic waves.

The condition in the step (A1) is not particularly limited as long as the carrier (i) can adsorb $^{226}$Ra ions, but for example, the step (A1) can be performed under a neutral or alkaline condition, and is preferably performed under an alkaline condition. The alkaline condition is more preferably an alkaline condition in which the pH is adjusted using at least one selected from the group consisting of ammonia, a hydroxide of an alkali metal, a carbonate of an alkali metal, and an alkaline buffer. Therefore, metal ions (for example, aluminum, zinc, iron, lead, copper, and silver) contained in the $^{226}$Ra-containing substance and easily precipitated under the alkaline condition can be precipitated, and a state in which the metal ions are hardly adsorbed onto the carrier (i) can be obtained. In addition, $^{226}$Ra can be efficiently adsorbed onto the carrier (i). The step (A1) is more preferably performed under an alkaline condition in which the pH is adjusted using ammonia. Therefore, since an alkali metal salt does not remain in the subsequent steps, a solution containing recovered $^{226}$Ra can also be suitably used for applications in which the residual alkali metal salt may adversely affect, such as using a solution containing recovered $^{226}$Ra for electrodeposition, and the use of the solution containing recovered $^{226}$Ra is widened.

Examples of the hydroxide of an alkali metal include lithium hydroxide, sodium hydroxide, potassium hydroxide, rubidium hydroxide, and cesium hydroxide. Examples of the carbonate of an alkali metal include sodium carbonate, potassium carbonate, lithium carbonate, and cesium carbonate. Examples of the alkaline buffer include a borate buffer, a Tris buffer, a phosphate buffer, and a McIlvaine buffer.

When the pH is adjusted to an alkaline condition, the pH may be adjusted at any timing before contacting the processing solution with the carrier (i). That is, the alkaline condition may be applied after the solid-state $^{226}$Ra-containing substance is immersed in the processing solution under a neutral condition, the solid-state $^{226}$Ra-containing substance may be immersed in the processing solution and at the same time the alkaline condition may be applied, or the alkaline condition may be applied before the solid-state $^{226}$Ra-containing substance is immersed in the processing solution.

<Solid-State $^{226}$Ra-Containing Substance>

The solid-state $^{226}$Ra-containing substance is not particularly limited as long as it is a substance containing $^{226}$Ra and is in a solid state at 25° C. The solid state means that the $^{226}$Ra-containing substance does not have fluidity when allowed to stand on a horizontal plane at 25° C.

The solid-state $^{226}$Ra-containing substance is preferably at least one selected from the group consisting of uranium slag and a radium source.

Here, a radium source in which $^{226}$Ra is sealed for radiation therapy is well known. A structure of the radium source is not particularly limited, and radium sources having various structures can be used. In general, $^{226}$Ra is sealed and accommodated in a single or double casing containing, for example, iron, titanium, platinum, or platinum iridium.

The shape and size of the radium source are not particularly limited, examples of the shape include a needle shape (long rod shape), a tubular shape, a plate shape, a rugby ball shape, and a spherical shape, and the shape is preferably a needle shape (long rod shape). The size is preferably 1 to 50 mm in length and 0.5 to 5.0 mm in diameter.

A chemical form of $^{226}$Ra contained in the radium source is not particularly limited, and various chemical forms can be used. The chemical form of $^{226}$Ra contained in the radium source is often radium sulfate and rarely radium bromide.

Uranium slag (also referred to as slag) is an unnecessary substance separated when uranium ore is refined, and a composition and a refining step are not particularly limited.

Crude refining of the uranium ore is performed, for example, in the following steps.

The uranium ore is crushed and pulverized, and dissolved with an acid or alkali, uranium is leached into a liquid, and then, solid-liquid separation is performed. The obtained liquid is subjected to solvent extraction using an ion exchange resin to remove impurities, and uranium is concentrated to obtain a purified uranium solution. A precipitate obtained by allowing the purified uranium solution to stand is called a yellow cake. Therefore, more specifically, the uranium slag is a combination of the solid obtained by the solid-liquid separation and the waste solution discharged in the step of obtaining the yellow cake from the purified uranium solution in the step described above. That is, the uranium slag includes solid-state uranium slag and liquid-state uranium slag.

The uranium ore contains $^{226}$Ra although a concentration thereof is significantly small. Since $^{226}$Ra transitions to slag in the crude refining step, the solid-state slag (solid obtained by solid-liquid separation) and the liquid-state slag (waste solution discharged in the step of obtaining the yellow cake from the purified uranium solution) contain $^{226}$Ra. A content of $^{226}$Ra in the solid-state slag and the liquid-state slag can vary depending on the type of uranium ore and the uranium crude refining step, and it is considered that the content of $^{226}$Ra in the solid-state slag is higher.

A step of obtaining a yellow cake from uranium ore is generally called crude refining, and is performed in a factory established side by side with a uranium mine. The uranium slag is discarded in a large quantity in a uranium slag dam adjacent to the factory. Therefore, it is meaningful to recover $^{226}$Ra from the uranium slag not only in that $^{226}$Ra having a finite amount existing on the earth can be used without waste, but also in that environmental pollution due to $^{226}$Ra can be prevented.

<Carrier (i)>

The carrier (i) is not particularly limited as long as it has a function of adsorbing $^{226}$Ra ions. The carrier (i) is preferably a carrier that can form a complex with a metal ion under an acidic condition or an alkaline condition and can elute the metal ion under an alkaline condition or an acidic condition opposite to a condition of the complex formation. Examples of the carrier (i) include a carrier capable of exchanging $^{226}$Ra ions, and the carrier (i) is preferably a carrier having a group capable of exchanging $^{226}$Ra ions. Specific examples of the group capable of exchanging $^{226}$Ra ions include carriers having an iminodiacetic acid group, a polyamine group, and a methyl glycan group, and an iminodiacetic acid group is preferable. The carrier having a group capable of exchanging $^{226}$Ra ions is not particularly limited as long as a group capable of exchanging $^{226}$Ra ions is held in a solid phase carrier such as a resin. Preferred examples of the carrier having a group capable of exchanging $^{226}$Ra ions include a styrene divinylbenzene copolymer holding an iminodiacetic acid group. Examples of a commercially available product of the resin having such an iminodiacetic acid group include "Chelex" series manufactured by Bio-Rad Laboratories, Inc., "Diaion" series manufactured by Mitsubishi Chemical Corporation, and "Amberlite" series manufactured by The Dow Chemical Company, and more specific examples thereof include "Chelex100" (particle size: 50 to 100 mesh, ion type: Na type and Fe type) manufactured by Bio-Rad Laboratories, Inc.

In addition, another example of the carrier (i) includes a carrier containing a compound represented by the following Formula (B). Examples of a commercially available product of the carrier (i) include "Ln Resin", "Ln2 Resin", and "Ln3 Resin" manufactured by Eichrom Technologies, Inc.

[Chem. 1]

(B)

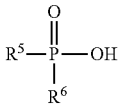

In Formula (B), $R^5$ and $R^6$ are each independently —R' or —OR' (R' is an alkyl group having 8 carbon atoms). The alkyl group having 8 carbon atoms in R' may be linear or branched, and preferred examples thereof include an octyl group, a 2-ethylhexyl group, and a 2-methyl-4,4-dimethylpentyl group.

Preferred examples of the compound represented by Formula (B) include compounds represented by the following Formulas (B-1) to (B-3).

[Chem. 2]

(B-1)

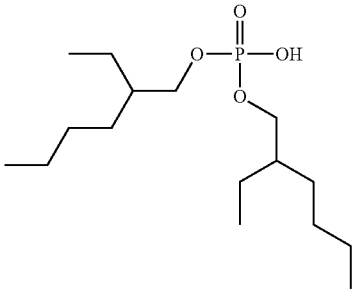

[Chem. 3]

(B-2)

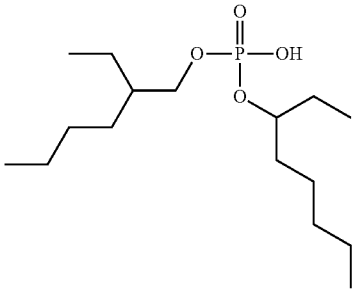

-continued

[Chem. 4]

(B-3)

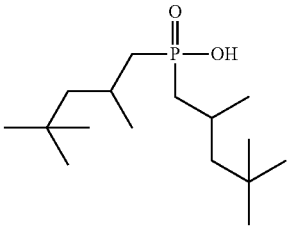

In addition, another example of the carrier (i) includes a carrier containing 1-octanol containing a compound represented by the following Formula (III). Specifically, an example of the carrier (i) is a carrier containing 1-octanol containing 4,4'-bis(t-butylcyclohexano)-18-crown-6 or 1-octanol containing 4,5'-bis(t-butylcyclohexano)-18-crown-6. Examples of the commercially available product of the carrier (i) include "Sr Resin" manufactured by Eichrom Technologies, Inc.

[Chem. 5]

Formula III

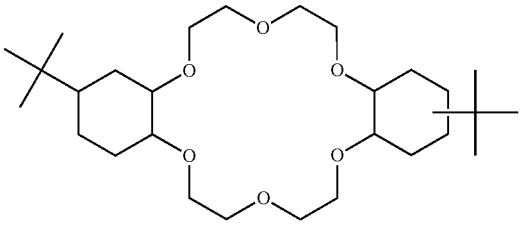

The amount of the carrier (i) used is not particularly limited, and may be determined according to the amount of the solid-state $^{226}$Ra-containing substance. When the solid-state $^{226}$Ra-containing substance is a radium source, for example, when the radium source is 10 mg or less, about 1 mL of the carrier (i) can be used.

The carrier (i) is preferably used by being filled in a bag or pack. The bag or pack is not particularly limited as long as it can be filled with the carrier (i) and does not adsorb $^{226}$Ra. The bag or pack is preferably a meshed bag or pack formed of an α-olefin such as polyethylene or polypropylene, and more preferably a meshed bag formed of at least one selected from polyethylene and polypropylene. The shape and size of the bag or pack are also not particularly limited. A 2 cm square bag is preferable, and a 2 cm square tetrahedron is more preferable.

By using the bag or pack, the step (A2) of separating the carrier (i) from the processing solution can be easily performed. In addition, after $^{226}$Ra is eluted from the carrier (i), the carrier (i) can be simply discarded while being filled in a bag or pack without radioactively contaminating other instruments and devices.

<Processing Solution>

The processing solution is a liquid containing water as a solvent, which is used for immersing the solid-state $^{226}$Ra-containing substance and the carrier (i).

A content of water in the processing solution is not particularly limited, but is preferably as large as possible because a solvent in which $^{226}$Ra ions are dissolved increases, and attenuation of ultrasonic waves is small.

The processing solution may contain a liquid other than water. Examples of the liquid other than water include ethanol, methanol, and glycerin. In addition, a preservative may be added to these solutions.

The processing solution may contain liquid-state slag. When the processing solution contains liquid-state slag, since $^{226}$Ra is recovered not only from solid-state slag but also from liquid-state slag, and as a result, the amount of $^{226}$Ra recovered increases, which is preferable.

The pH of the processing solution is not particularly limited. For example, when the step (A1) is performed under an alkaline condition, the processing solution is preferably an alkaline aqueous solution, and the pH is preferably 8 or more and more preferably 9 or more. The pH adjustment is preferably performed using at least one selected from the group consisting of ammonia, a hydroxide or a carbonate of an alkali metal, and an alkaline buffer. Therefore, $^{226}$Ra can be adsorbed onto the carrier (i).

The processing solution preferably contains no alkaline earth metal. Since the alkaline earth metal is easily adsorbed onto the carrier (i), when the processing solution does not contain the alkaline earth metal, it is easy to avoid recovery of the alkaline earth metal together with $^{226}$Ra.

The amount of the processing solution is not particularly limited, and is preferably an amount in which at least the entire carrier (i) can be completely immersed in the processing solution. When a bag or pack is filled with the carrier (i), the amount of the processing solution that allows the entire bag or pack to be completely immersed in the processing solution is preferable.

<Irradiation with Ultrasonic Waves>

A frequency of the ultrasonic wave to be radiated is not particularly limited as long as it is 16 kHz or more, and is preferably 16 to 120 kHz, more preferably 19 to 100 kHz, and still more preferably 20 to 80 kHz. When the frequency of the ultrasonic wave is within the above range, $^{226}$Ra can be efficiently extracted from the solid-state $^{226}$Ra-containing substance, and $^{226}$Ra can be efficiently adsorbed onto the carrier (i).

An ultrasonic generator is not particularly limited, and for example, a water-tank ultrasonic cleaner, or an ultrasonic crusher (also referred to as an ultrasonic disperser or an ultrasonic homogenizer) can be used. The water-tank ultrasonic cleaner is preferable because ultrasonic waves can be radiated without radioactive contamination of the ultrasonic generator.

An output of the ultrasonic generator is not particularly limited, and is preferably 10 to 800 W, more preferably 20 to 600 W, and still more preferably 30 to 400 W. When the output of the ultrasonic generator is within the above range, $^{226}$Ra can be efficiently extracted from the solid-state $^{226}$Ra-containing substance, and $^{226}$Ra can be efficiently adsorbed onto the carrier (i).

The ultrasonic generator may include a thermostat in order to suppress a temperature rise of the ultrasonic generator and the processing solution due to the irradiation with the ultrasonic waves. A temperature of the thermostat is, for example, 10 to 25° C.

The irradiation with the ultrasonic waves can be performed one time or a plurality of times at appropriate intervals, for example, one time or two to five times per day, preferably one to three times per day or one time or two to five times per two or three days, and preferably one to three times per two or three days. The irradiation with the ultrasonic waves is performed, for example, for 1 to 60 days, and preferably 2 to 30 days. When the irradiation with the ultrasonic waves is within the above range, $^{226}$Ra can be efficiently extracted from the solid-state $^{226}$Ra-containing substance, and $^{226}$Ra can be adsorbed onto the carrier (i).

The irradiation time of ultrasonic waves per irradiation is, for example, 10 seconds to 1 hour, preferably 1 minute to 45 minutes, and more preferably 15 minutes to 45 minutes depending on the frequency or the number of times of irradiation. The total irradiation time of the ultrasonic waves is, for example, 0.1 hours or longer, preferably 0.5 to 50 hours, more preferably 0.5 to 20 hours, and still more preferably 0.5 to 10 hours. When the irradiation time is within the above range, $^{226}$Ra can be efficiently extracted from the solid-state $^{226}$Ra-containing substance, and $^{226}$Ra can be adsorbed onto the carrier (i).

The recovery method (X) preferably includes, after the step (A1), a step (A2) of separating the carrier (i) from the processing solution, and a step (A3) of eluting $^{226}$Ra from the carrier (i) separated in the step (A2) using an acid.

Step (A2)

In the step (A2), the carrier (i) onto which $^{226}$Ra is adsorbed in the step (A1) is separated from the processing solution.

The separation method is not particularly limited, and for example, the carrier (i) onto which $^{226}$Ra is adsorbed can be collected on a filter and separated from the processing solution by filtration with a membrane filter. When a bag or pack is filled with the carrier (i), the carrier (i) can be separated from the processing solution by lifting the bag or pack filled with the carrier (i) using tweezers.

Step (A3)

In the step (A3), $^{226}$Ra is eluted from the carrier (i) onto which $^{226}$Ra is adsorbed using an acid. Specifically, for example, $^{226}$Ra adsorbed onto the carrier (i) can be eluted by passing an acid through the carrier (i) or immersing the carrier (i) in an acid.

The acid is not particularly limited as long as it can dissolve $^{226}$Ra adsorbed onto the carrier (i) to form ions, and is preferably at least one selected from the group consisting of hydrochloric acid and nitric acid.

A concentration of the acid is preferably 0.01 to 10 mol/L, more preferably 0.1 to 5 mol/L, and still more preferably 0.3 to 2 mol/L, from the viewpoint of efficiently eluting $^{226}$Ra from the carrier and from the viewpoint of efficiently removing anions derived from the acid in a subsequent step.

The step (A2) and the step (A3) are preferably performed after repeating the step (A1) a plurality of times. Therefore, $^{226}$Ra can be efficiently recovered.

The number of repetitions of the step (A1) is not particularly limited, and the step (A2) and the step (A3) are preferably performed after the step (A1) is performed 2 to 10 times, and more preferably performed after the step (A1) is performed 3 to 5 times.

In the recovery method (X), it is preferable to perform the following step (A4) and step (A5) after performing the step (A3).

Step (A4): Step of filtering the eluate obtained in the step (A3) through a filter Step (A5): Step of adjusting the pH of the filtrate obtained in the step (A4) and then performing filter filtration Step (A4)

In the step (A4), a substance precipitated under an acidic condition can be removed by filtering the eluate containing $^{226}$Ra obtained in the step (A3) through a filter.

The filter used for filter filtration is not particularly limited, and examples of a material of the filter include a fluorocarbon system, a cellulose system, a nylon system, a polyester system, and a hydrocarbon system. A pore size of the filter can be appropriately selected according to a target cleanliness, and is preferably 1 μm or less and more preferably 0.5 μm or less. In the filtration method, the solution may be passed only once, and it is more preferable to perform filtration a plurality of times.

Step (A5)

In the step (A5), a substance precipitated under a pH condition different from that in the step (A3) can be removed by performing filter filtration after adjusting the pH of the filtrate containing $^{226}$Ra obtained in the step (A4). The filter used for the filter filtration can be appropriately selected based on the same criteria as those in the step (A4).

In the step (A5), it is preferable to adjust the pH of the filtrate to an alkaline condition using ammonia. Therefore, the substance that precipitates under an alkaline condition can be removed.

The step (A1) to the step (A5) are preferably repeated a plurality of times. Therefore, $^{226}$Ra can be efficiently recovered. The number of repetitions is not particularly limited, and the step (A1) to the step (A5) are preferably performed 2 to 10 times, and are more preferably performed 3 to 5 times.

Other Steps

The recovery method (X) may include, between each of the step (A2) to the step (A5), a step of cleaning the carrier (i). Specifically, examples thereof include passing water through the carrier (i). By doing so, a percentage of impurities contained in the solution containing recovered $^{226}$Ra can be reduced, and a recovery rate of $^{226}$Ra can be increased.

[Production Method of $^{226}$Ra Solution]

A production method of a $^{226}$Ra solution (hereinafter, also referred to as a "production method (Y)") in one aspect of the present invention includes: a step (A1) of immersing a solid-state $^{226}$Ra-containing substance and a carrier (i) in a processing solution and then irradiating the processing solution with ultrasonic waves; a step (A2) of separating the carrier (i) from the processing solution; and a step (A3) of eluting $^{226}$Ra from the carrier (i) separated in the step (A2) using an acid. The $^{226}$Ra solution produced by the production method (Y) is referred to as a $^{226}$Ra solution (a).

Since the $^{226}$Ra solution (a) contains $^{226}$Ra with a high purity, the $^{226}$Ra solution (a) can be used for various applications, and is preferably used for producing a $^{226}$Ra target.

In the production method (Y), it is preferable to perform the following step (A4) and step (A5) after performing the step (A3).

Step (A4): Step of filtering the eluate obtained in the step (A3) through a filter Step (A5): Step of adjusting the pH of the filtrate obtained in the step (A4) and then performing filter filtration The step (A1) to the step (A5) in the production method (Y) can be performed in the same manner as those in the step (A1) to the step (A5) in the production method (X) described above.

[Production Method of $^{225}$Ac Solution]

A production method of a $^{225}$Ac solution in one aspect of the present invention includes: a step (B1) of obtaining a $^{226}$Ra solution (α) by the production method (Y) and a step (B2) of producing a $^{225}$Ac solution from the $^{226}$Ra solution (α).

In the step (B1), the production method (Y) is performed to obtain a $^{226}$Ra solution (α).

In the step (B2), a $^{225}$Ac solution is produced from the $^{226}$Ra solution (α). The method for producing a $^{225}$Ac solution is not particularly limited, and examples thereof include the following methods.

An electrodeposition solution is prepared using the $^{226}$Ra solution (α), and $^{226}$Ra is electrodeposited on a substrate using the electrodeposition solution, thereby producing a $^{226}$Ra target. The $^{226}$Ra target is irradiated with at least one selected from the group consisting of charged particles, photons, and neutrons using an accelerator to produce $^{225}$Ac by a nuclear reaction. The irradiated $^{226}$Ra target is dissolved in an acidic acid solution to obtain a $^{225}$Ac solution containing $^{225}$Ac ions.

When an electrodeposition solution is prepared using the $^{226}$Ra solution (α), it is preferable that the processing solution in the step (B1) does not contain an alkali metal salt.

As described above, the aspects of the present invention described based on the embodiments include the following technical ideas.

[1] A recovery method of $^{226}$Ra including a step (A1) of immersing a solid-state $^{226}$Ra-containing substance and a carrier having a function of adsorbing $^{226}$Ra ions in a processing solution, and then irradiating the processing solution with ultrasonic waves.

[2] The recovery method of $^{226}$Ra according to [1], in which the solid-state $^{226}$Ra-containing substance is at least one selected from the group consisting of uranium slag and a radium source.

[3] The recovery method of $^{226}$Ra according to [1] or [2], in which the carrier is capable of exchanging $^{226}$Ra ions.

[4] The recovery method of $^{226}$Ra according to any one of [1] to [3], in which the carrier contains an iminodiacetic acid group.

[5] The recovery method of $^{226}$Ra according to any one of [1] to [4], further including a step (A2) of separating the carrier from the processing solution, and a step (A3) of eluting $^{226}$Ra from the carrier separated in the step (A2) using an acid.

[6] The recovery method of $^{226}$Ra according to [5], in which the acid is at least one selected from the group consisting of hydrochloric acid and nitric acid.

[7] A production method of a $^{226}$Ra solution, including:

a step (A1) of immersing a solid-state $^{226}$Ra-containing substance and a carrier having a function of adsorbing $^{226}$Ra ions in a processing solution, and then irradiating the processing solution with ultrasonic waves;

a step (A2) of separating the carrier from the processing solution; and a step (A3) of eluting $^{226}$Ra from the carrier separated in the step (A2) using an acid.

[8] A production method of a $^{225}$Ac solution, including: a step (B1) of obtaining a $^{226}$Ra solution by the production method of a $^{226}$Ra solution according to [7], and a step (B2) of producing a $^{225}$Ac solution from the $^{226}$Ra solution.

[9] The recovery method of $^{226}$Ra according to [5] or [6], in which the step (A2) and the step (A3) are performed after the step (A1) is repeated a plurality of times.

[10] The recovery method of $^{226}Ra$ according to any one of [5], [6], and [9], in which the following step (A4) and step (A5) are performed after the step (A3) is performed:

step (A4): a step of filtering the eluate obtained in the step (A3) through a filter; and step (A5): a step of adjusting the pH of the filtrate obtained in the step (A4) and then performing filter filtration.

[11] The recovery method of $^{226}Ra$ according to [10], in which in the step (A5), the pH of the filtrate is adjusted under an alkaline condition using ammonia.

EXAMPLES

Next, the present invention will be described in more detail with reference to Examples, but the present invention is not limited thereto.

Example 1

All the following operations were performed in a glove box. A radium source (3 mm in diameter, 20 mm in length) containing an unknown chemical form of radium was cut with a nipper into 5 to 6 small pieces. Chelex-100 resin (manufactured by Bio-Rad Laboratories, Inc., particle size: 50 to 100 mesh, ion type: Na type, used amount: 1 mL) converted to $NH_4^+$ type was placed in a bag (meshed, made of polyethylene and polypropylene, shape: 2 cm square tetrahedron), and the bag was closed. The bag containing Chelex-100 resin and radium source small pieces were placed in a 100 mL glass bottle, and then 0.5 mL of 14% aqueous ammonia (manufactured by Nacalai Tesque Inc.) was added to adjust the pH to 10. The bottle was placed in a treatment tank (water bath tank) of a water-tank ultrasonic generator (manufactured by SND Co., Ltd., US-610, output 110 W, frequency 44 kHz), and the bottle was irradiated with ultrasonic waves for 30 minutes. The irradiation with the ultrasonic waves was repeated a plurality of times, once every two or three days. The bottle after the irradiation with the ultrasonic waves was allowed to stand at room temperature until the next irradiation with the ultrasonic waves. The bag containing Chelex-100 resin was taken out with tweezers, and the bag was placed in a glass bottle containing 15 mL of 0.7 M nitric acid (first bottle). After several days, the bag containing Chelex-100 resin was taken out from the glass bottle containing 15 mL of 0.7 M nitric acid with tweezers, and the bag was placed in another glass bottle containing 15 mL of 0.7 M nitric acid (second bottle). After several days, the bag containing Chelex-100 resin was taken out from the second glass bottle containing 15 mL of 0.7 M nitric acid with tweezers. The eluents of the first bottle and the second bottle were combined to form a $^{226}Ra$-containing solution (a-1). The pH was 0 to 2.

The $^{226}Ra$-containing solution (a-1) was filtered through a membrane filter (manufactured by NMP, D.L.L Filter, hole diameter 0.2 μm) to remove an acidic precipitate. The filtrate was used as a $^{226}Ra$-containing solution (a-2). 14% aqueous ammonia (prepared by diluting aqueous ammonia (manufactured by Nacalai Tesque Inc., 02512-95)) was added to the $^{226}Ra$-containing solution (a-2) until the solution became alkaline (pH of 9 to 11), and then the solution was filtered through a membrane filter to remove a basic precipitate. The filtrate was used as a $^{226}Ra$-containing solution (a-3).

A medical tube (manufactured by HAKKOSHA CO., Ltd., 3.2×4.4×500 mm (4 mL)) having an inner diameter of 3.2 mm, an outer diameter of 4.4 mm, and a length of 50 cm was filled with a substance obtained by converting Chelex100 (used amount: 3 mL) to $NH_4^+$ type.

Next, the anion exchange resin (Monosphere 550A) (manufactured by FUJIFILM Wako Chemical Corporation, particle size: 590±50 μm mesh, ion type: OH type, used amount: 16 mL) was washed with water and then filled in a medical tube (manufactured by HAKKOSHA CO., Ltd., 3.2×4.4×500 mm (4 mL) having an inner diameter of 3.2 mm, an outer diameter of 4.4 mm, and a length of 50 cm), and the medical tube was connected next to the tube filled with Chelex100. The $^{226}Ra$-containing solution (a-3) was allowed to pass through Chelex100 and the anion exchange resin. This passing solution was used as a waste solution. Thereafter, 10 mL of 1 mol/L nitric acid and then 10 mL of water were allowed to pass through Chelex100 and the anion exchange resin at a flow rate of 1 to 2 mL/min, and 20 mL of the eluted solution was used as a purified $^{226}Ra$-containing solution (a-4).

The radium source small pieces once treated in the above step were subjected to re-extraction by the following procedure. A bag containing Chelex-100 resin was added to a 100 mL glass bottle containing radium source small pieces, and irradiation with ultrasonic waves was performed in the same manner as described above. Thereafter, the bag containing Chelex-100 resin was taken out, and the bag was placed in a glass bottle containing 15 mL of 0.7 M nitric acid (first bottle). After several days, the bag containing Chelex-100 resin was taken out from the first glass bottle containing 15 mL of 0.7 M nitric acid with tweezers, and the bag was placed in another glass bottle containing 15 mL of 0.7 M nitric acid (second bottle). After several days, the bag containing Chelex-100 resin was taken out from the second glass bottle containing 15 mL of 0.7 M nitric acid with tweezers. After elution with 15 mL of 0.7 M nitric acid, the procedure until the purified $^{226}Ra$-containing solution (a-4) was obtained was performed in the same manner as described above. Note that the bag containing Chelex-100 resin and aqueous ammonia that were used first were used again. The re-extraction procedure was repeated twice until no radioactivity was detected in the 100 mL glass bottle containing the radium source small pieces.

The purified $^{226}Ra$-containing solution (a-4) was subjected to radioactivity measurement with a germanium semiconductor detector. In addition, for the Chelex-100 resin, radium source small pieces, materials (membrane filter, anion exchange resin, plastic instrument, and glass instrument), and waste solution, in order to examine the distribution of residual $^{226}Ra$, radioactivity measurement was performed with a germanium semiconductor detector, and the mass balance of $^{226}Ra$ was calculated. The results are shown in Table 1. Note that since the same procedure was repeated 3 times, the measured radioactivity value was the sum of three measurements.

TABLE 1

| | Numerical value | Percentage |
|---|---|---|
| Radium source before start of experiment (calculated value) | 1264 μCi | 100% |
| Residual in radium source | N.D. | — |
| Residual in Chelex after elution | 12 μCi | 1% |
| Residual in material (excluding Chelex) | N.D. | — |
| Waste solution | N.D. | — |
| Purified $^{226}Ra$-containing solution (a-4) | 1252 μCi | 99% |

In Table 1, the radioactivity of the radium source before the start of the experiment was calculated from the following Calculation Formula (1).

Radium source (calculated value) before start of experiment=purified $^{226}$Ra-containing solution (a-4)+residual in radium source+residual in Chelex100 resin after elution+residual in material+waste solution (1)

The recovery rate of $^{226}$Ra (purified $^{226}$Ra-containing solution (a-4)/radium source before start of experiment×100) was 99%. In addition, a loss rate of $^{226}$Ra (residual in Chelex100 resin after elution/purified $^{226}$Ra-containing solution (a-4)×100) was 1%.

Comparative Example 1

All the following operations were performed in a glove box. A radium source (3 mm in diameter, 20 mm in length) containing an unknown a chemical form of radium was cut with a nipper into 5 to 6 small pieces. The contents were drilled out of the radium source pieces using a needle. Since radium sulfate was often used in a legacy radium source, the chemical form of the contained radium was predicted to be radium sulfate. Therefore, radium was recovered by heating in a sodium carbonate aqueous solution.

The content of the drilled radium source was placed in a glass bottle, 2 mL of 1.5 M sodium carbonate (manufactured by Nacalai Tesque Inc., 31311-25, prepared by dissolving sodium carbonate in water) was added, and heating was performed at 80° C. for 1 hour. The content of the bottle was filtered through a membrane filter, and the filtrate was used as a waste solution (b-1). The residue remaining on the filter was dissolved in 10 mL of 1 M hydrochloric acid (manufactured by Nacalai Tesque Inc., 18429-15, prepared diluting hydrochloric acid), but a part of the residue was not dissolved and remained. The residue (considered to be radium sulfate) was used as a residue (b-2). The solution dissolved in 1 M hydrochloric acid was filtered through a membrane filter to remove an acidic precipitate. 14% aqueous ammonia (manufactured by Nacalai Tesque Inc., 02512-95, prepared by diluting aqueous ammonia) was added to the filtrate until the solution became alkaline (pH of 9 to 11), and then the solution was filtered through a membrane filter to remove a basic precipitate, thereby obtaining a $^{226}$Ra-containing solution.

A medical tube (manufactured by HAKKOSHA CO., Ltd., 3.2×4.4×500 mm (4 mL)) having an inner diameter of 3.2 mm, an outer diameter of 4.4 mm, and a length of 50 cm was filled with a substance obtained by converting Chelex100 (used amount: 3 mL) to $NH_4^+$ type.

Next, the anion exchange resin (Monosphere 550A) (manufactured by FUJIFILM Wako Chemical Corporation, particle size: 590±50 μm mesh, ion type: OH type, used amount: 16 mL) was washed with water and then filled in a medical tube (manufactured by HAKKOSHA CO., Ltd., 3.2×4.4×500 mm (4 mL) having an inner diameter of 3.2 mm, an outer diameter of 4.4 mm, and a length of 50 cm), and the medical tube was connected next to the tube filled with Chelex100. The $^{226}$Ra-containing solution after removal of the basic precipitate was allowed to pass through Chelex100 and the anion exchange resin. Thereafter, 10 mL of 1 mol/L nitric acid and then 10 mL of water were allowed to pass through Chelex100 and the anion exchange resin at a flow rate of 1 to 2 mL/min, and 20 mL of the eluted solution was used as a purified $^{226}$Ra-containing solution (b-3).

The radium source small pieces once used in the above step were subjected to re-extraction by the following procedure. The radium source small pieces were placed in a glass bottle again, and a procedure from heating at 80° C. for 1 hour in 1.5 M sodium carbonate to obtaining a purified $^{226}$Ra-containing solution (b-3) was performed in the same manner as described above. The re-extraction procedure was repeated 4 times.

The purified $^{226}$Ra-containing solution (b-3) was subjected to radioactivity measurement with a germanium semiconductor detector. In addition, for the waste solution (b-1), residue (b-2), and materials (membrane filter, anion exchange resin, plastic instrument, and glass instrument), in order to examine the distribution of residual $^{226}$Ra, radioactivity measurement was performed with a germanium semiconductor detector, and the mass balance of $^{226}$Ra was calculated. The results are shown in Table 2. Note that since the same procedure was repeated 5 times, the measured radioactivity value was the sum of five measurements.

TABLE 2

| | Numerical value | Percentage |
|---|---|---|
| Radium source before start of experiment (calculated value) | 1631 μCi | 100% |
| Residual in radium source | 1264 μCi | 77% |
| Waste solution (b-1) | 12 μCi | 1% |
| Residue (b-2) | 10 μCi | 0.6% |
| Purified $^{226}$Ra-containing solution (b-3) | 345 μCi | 21% |
| Residual in material | N.D. | — |

In Table 2, the radioactivity of the radium source before the start of the experiment was calculated from the following Calculation Formula (2).

Radium source (calculated value) before start of experiment=residual in radium source+waste solution (b-1)+residue (b-2)+purified $^{226}$Ra-containing solution (b-3)+residual in material (2)

The recovery rate of $^{226}$Ra (purified $^{226}$Ra-containing solution (b-3)/radium source before start of experiment×100) was 21%. In addition, a loss rate of $^{226}$Ra (waste solution (b-1)+residue (b-2)/purified $^{226}$Ra-containing solution (b-3)×100) was 6%.

Example 2

A legacy radium needle (1.6 mm in diameter, 25 mm in length, having 37 to 74 MBq (1 to 2 mCi) of radioactivity of $^{226}$Ra) containing an unknown chemical form of radium was cut with a nipper (for 1/16" stainless tube) into 5 or 6 small pieces. The small pieces were placed in a 50 mL glass bottle (manufactured by Duran Wheaton Kimble) with a propylene screw cap. Chelex-100 resin (manufactured by Bio-Rad Laboratories, Inc., particle size: 50 to 100 mesh, ion type: Na type, used amount: 3 mL) converted to $NH_4^+$ type, 7 mL of water, and 28% aqueous ammonia were added to the glass bottle, to adjust the pH to 10. The glass bottle was placed in a treatment tank (water bath tank) of a water-tank ultrasonic generator (manufactured by SND Co., Ltd., US-350S, output 40 W, frequency 38 kHz), and the bottle was irradiated with ultrasonic waves for 5 minutes. Irradiation with ultrasonic waves was performed about one to three times a day. A series of operations of performing irradiation with ultrasonic waves and leaving for several days was repeated for one week. The glass bottle after the irradiation of the ultrasonic waves was allowed to stand at room temperature until the next irradiation of the ultrasonic waves. The content of the glass bottle was placed in an empty cartridge (Bond Elut, 5 mL, manufactured by Agilent Technologies Inc.), and the Chelex-100 resin was filtered. To the cartridge, 5 mL of 1 M hydrochloric acid was added, and then 10 ml of purified water was added to elute $^{226}$Ra. The eluate was used as a $^{226}$Ra-containing solution (c-1). The pH was estimated to be 0 to 1.

The $^{226}$Ra-containing solution (c-1) was passed through an anion exchange resin (Monosphere 550A) (manufactured by FUJIFILM Wako Chemical Corporation, particle size: 590±50 μm mesh, ion type: OH type, used amount: 16 mL) to remove chloride ions. Subsequently, 10 mL of purified water was allowed to pass through to wash the anion exchange resin. The eluate was used as a purified $^{226}$Ra-containing solution (c-1). The purified $^{226}$Ra-containing solution (c-1) was concentrated under reduced pressure at 130° C. to recover $^{226}$Ra as dried hydroxide radium.

The purified $^{226}$Ra-containing solution (c-1) was subjected to radioactivity measurement with a germanium semiconductor detector. In addition, for the Chelex-100 resin, radium needle pieces, and materials (cartridge, anion exchange resin, and plastic instrument), in order to examine the distribution of residual $^{226}$Ra, radioactivity measurement was performed with a germanium semiconductor detector, and the mass balance of $^{226}$Ra was calculated. The recovery rate of $^{226}$Ra from the radium needle was about 30 to 50%.

In order to recover residual $^{226}$Ra in the filtered Chelex-100 resin, the filtered Chelex-100 resin was placed in a 50 mL glass bottle with a propylene screw cap, 7 mL of water and aqueous ammonia were added, to adjust the pH to 10, and the glass bottle was allowed to stand for one month without being irradiated with ultrasonic waves. The procedure from the step of filtering the Chelex-100 resin using an empty cartridge to the step of obtaining dried hydroxide radium was performed in the same manner as described above. The $^{226}$Ra-containing solution obtained by re-extraction was used as a purified $^{226}$Ra-containing solution (c-2).

The purified $^{226}$Ra-containing solution (c-2) was combined with the purified $^{226}$Ra-containing solution (c-1), and radioactivity was measured with a germanium semiconductor detector. As a result, the recovery rate of $^{226}$Ra from the radium needle was 100%.

The invention claimed is:

1. A recovery method of $^{226}$Ra comprising a step (A1) of immersing a solid-state $^{226}$Ra-containing substance and a carrier having a function of adsorbing $^{226}$Ra ions in a processing solution to obtain a processing liquid, the processing liquid comprising the solid-state $^{226}$Ra-containing substance, the carrier and the processing solution, and then irradiating the processing liquid with ultrasonic waves.

2. The recovery method of $^{226}$Ra according to claim 1, wherein the solid-state $^{226}$Ra-containing substance is at least one selected from the group consisting of uranium slag and a radium source.

3. The recovery method of $^{226}$Ra according to claim 1, wherein the carrier exchanges $^{226}$Ra ions.

4. The recovery method of $^{226}$Ra according to claim 1, wherein the carrier contains an iminodiacetic acid group.

5. The recovery method of $^{226}$Ra according to claim 1, further comprising: a step (A2) of separating the carrier from the processing solution; and a step (A3) of eluting $^{226}$Ra from the carrier separated in the step (A2) using an acid.

6. The recovery method of $^{226}$Ra according to claim 5, wherein the acid is at least one selected from the group consisting of hydrochloric acid and nitric acid.

7. A production method of a $^{226}$Ra solution, comprising:

a step (A1) of immersing a solid-state $^{226}$Ra-containing substance and a carrier having a function of adsorbing $^{226}$Ra ions in a processing solution, and then irradiating the processing solution with ultrasonic waves;

a step (A2) of separating the carrier from the processing solution; and a step (A3) of eluting $^{226}$Ra from the carrier separated in the step (A2) using an acid.

8. The recovery method of $^{226}$Ra according to claim 1, wherein a frequency of the ultrasonic waves is 16 kHz to 120 kHz.

9. A production method of a $^{225}$Ac solution, comprising: a step (B1) of obtaining a $^{226}$Ra solution by the production method of a $^{226}$Ra solution according to claim 7; and a step (B2) of producing a $^{225}$Ac solution from the $^{226}$Ra solution.

* * * * *